United States Patent [19]

Okada et al.

[11] Patent Number: 4,800,382

[45] Date of Patent: Jan. 24, 1989

[54] DRIVING METHOD FOR LIQUID CRYSTAL DEVICE

[75] Inventors: Shinjiro Okada, Kawasaki; Junichiro Kanbe, Yokohama, both of Japan

[73] Assignee: Canon Kabushiki Kaisha, Tokyo, Japan

[21] Appl. No.: 813,239

[22] Filed: Dec. 24, 1985

[30] Foreign Application Priority Data

Dec. 28, 1984 [JP] Japan ..... 59-276491

[51] Int. Cl.[4] ..... G09G 3/36

[52] U.S. Cl. ..... 340/784; 340/805; 350/350 S

[58] Field of Search ..... 340/784, 805; 350/331 R, 350 S

[56] References Cited

U.S. PATENT DOCUMENTS

| | | | |
|---|---|---|---|
| 4,367,924 | 1/1983 | Clark et al. | 350/334 |
| 4,380,008 | 4/1983 | Kawakami et al. | 340/805 |
| 4,548,476 | 10/1985 | Kaneko | 350/336 |
| 4,556,727 | 12/1985 | Walba | 252/299.5 |
| 4,625,204 | 11/1986 | Clerc | 340/805 |

FOREIGN PATENT DOCUMENTS

| | | |
|---|---|---|
| 0110299 | 6/1984 | European Pat. Off. . |
| 0115693 | 8/1984 | European Pat. Off. . |

OTHER PUBLICATIONS

Modulators, Linear Arrays, and Matrix Arrays Using Ferroelectric Liquid Crystals, Clark et al.; SID 1985, Feb.

"Voltage-Dependent Optical Activity of a Twisted Nematic Liquid Crystal", by M. Schadt and W. Helfrich, *Applied Physis Letters*, vol. 18, No. 4 (Feb. 15, 1981) pp. 127-128.

"Ferroelectric Liquid Crystals", by Meyer et al., *Le Jounal De Physique Lettres*, vol. 36 (Mar. 1975) pp. C69-C71.

"Submicrosecond Bistable Electr-Optic Switching in Liquid Crystals", by Clark et al., *Applied Physics Letters*, vol. 36, No. 11 (Jun. 1, 1980).

"Liquid Crystals", *Kotai Butsuri* (*Solid State Physics*), vol. 16, No. 141 (1981).

*Primary Examiner*—Gerald L. Brigance
*Assistant Examiner*—Jeffery A. Brier
*Attorney, Agent, or Firm*—Fitzpatrick, Cella, Harper & Scinto

[57] ABSTRACT

A driving method for a liquid crystal device of the type comprising a matrix electrode structure having scanning lines and data lines, and a ferroelectric liquid crystal. In the driving method, (a) in a first period, a scanning selection signal is applied to a scanning line and applying an information signal is applied to a data line in synchronism with the scanning selection signal, and (b) in a second period, an alternating auxiliary signal is applied to the data line.

42 Claims, 8 Drawing Sheets

DRIVING METHOD FOR LIQUID CRYSTAL DEVICE

FIELD OF THE INVENTION AND RELATED ART

The present invention relates to a driving method for a liquid crystal device such as a liquid crystal display device and a liquid crystal optical shutter array, and more particularly, to a driving method for a liquid crystal device having improved display and driving characteristics through improved initial orientation of liquid crystal molecules.

As a conventional liquid crystal device, there has been known, for example, one using TN (twisted nematic) type liquid crystals, as shown in "Voltage-Dependent Optical Activity of a Twisted Nematic Liquid Crystal" by M. Schadt and W. Helfrich, "Applied Physics Letters" vol. 18, No. 4 (Feb. 15, 1971), pp. 127–128. This TN-type liquid crystal device has the disadvantage that a crosstalk phenomenon occurs when a device having a matrix electrode structure arranged to provide a high picture element density is driven in a time division manner, so that the number of picture elements is restricted.

Further, a type of display device is known, in which each picture element is provided with a switching element comprising a thin film transistor connected thereto so that the picture elements are switched respectively. This type of device, however, requires an extremely complicated step for forming thin film transistors on a base plate, moreover, involves it is difficult to produce a large area of display device.

In order to solve these problems, a ferroelectric liquid crystal device, utilizing a ferroelectric liquid crystal placed under a bistability condition, has been developed by Clark et al. in, e.g., U.S. Pat. No. 4,367,924.

This ferroelectric liquid crystal device exhibit a memory effect, as explained hereinafter, but also has undesirable effects. More specifically, when a device is constructed to have a matrix electrode structure comprising scanning lines and data lines is driven in a time division manner, a picture element which has been written in one signal state by applying thereto a writing voltage above a threshold value of one polarity, can reverse the its signal state (e.g., from the written "white" state to an opposite "black" state) when continually subjected to a voltage of reverse polarity for a long period of, e.g., 5 times or more, as long as the writing voltage pulse duration, even when the voltage of reverse polarity is below a threshold voltage. This reversal phenomenon has been discovered by our experiments.

SUMMARY OF THE INVENTION

Accordingly, an object of the present invention is to provide a time division driving method for a ferroelectric liquid crystal device having a matrix electrode structure comprising scanning lines and data lines.

Another object of the present invention is to provide a driving method for a ferroelectric liquid crystal device for preventing the occurrence of the above mentioned reversal phenomenon.

According to the present invention, there is provided a driving method for a liquid crystal device of the type comprising a matrix electrode structure having scanning lines and data lines, and a ferroelectric liquid crystal, the driving method comprising: in a first time period, applying a scanning selection signal to a scanning line, and applying an information signal to a data line in synchronism with the scanning selection signal, and in a second time period, applying an alternating auxiliary signal to the data line.

These and other objects, features and advantages of the present invention will become more apparent upon a consideration of the following description of the preferred embodiments of the present invention taken in conjunction with the accompanying drawings.

DETAILED DESCRIPTION OF PREFERRED EMBODIMENTS

Ferroelectric liquid crystals which can be suitably used in the present invention are chiral smectic liquid crystals, particularly those showing chiral smectic C phase (SmC*), H phase (SmH*), I phase (SmI*), J phase (SmJ*), K phase (SmK*), G phase (SmG*) or F phase (SmF*) .

Ferroelectric liquid crystals are described in detail in, e.g., "LE JOURNAL DE PHYSIQUE LETTERS" 36 (L-69) 1975, "Ferroelectric Liquid Crystals": "Applied Physics Letters" 36 (11) 1980 "Submicrosecond Bistable Electro-optic Switching in Liquid Crystals"; "Kotai Butsuri (Solid State Physics)" 16 (141) 1981 "Liquid Crystals", etc. In the present invention, ferroelectric liquid crystals disclosed in these publication may be used.

Specific examples of ferroelectric liquid crystals to be used in the present invention include decyloxybenzylidene-p'-amino-2-methylbutyl cinnamate (DOBAMBC), hexyloxybenzylidene-p'-amino-2-chloropropyl cinnamate (HOBACPC), 4-o-(2-methyl)-butylresorcylidene-4'-octylaniline (MBRA 8) and those disclosed in European published Patent Applications EP-A No. 110299 and EP-A No. 115693.

Figure 1:
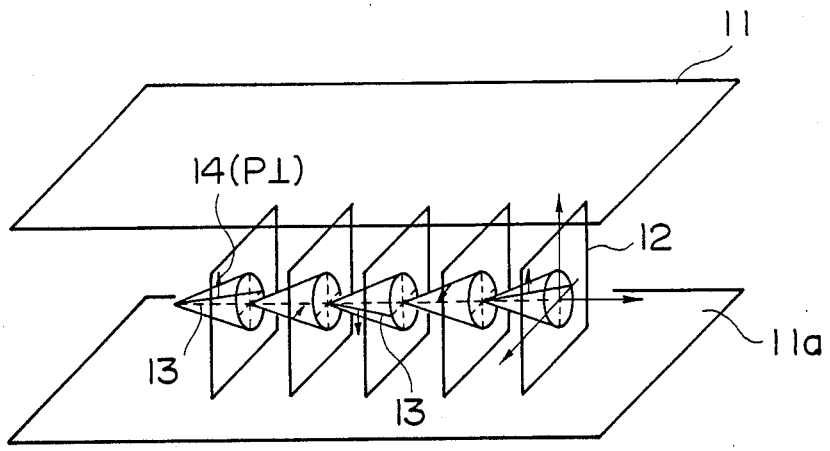
FIGS. 1 and 2 are schematic perspective views for explaining operating principles of a ferroelectric liquid crystal device to be used in the present invention.
Figure 2:
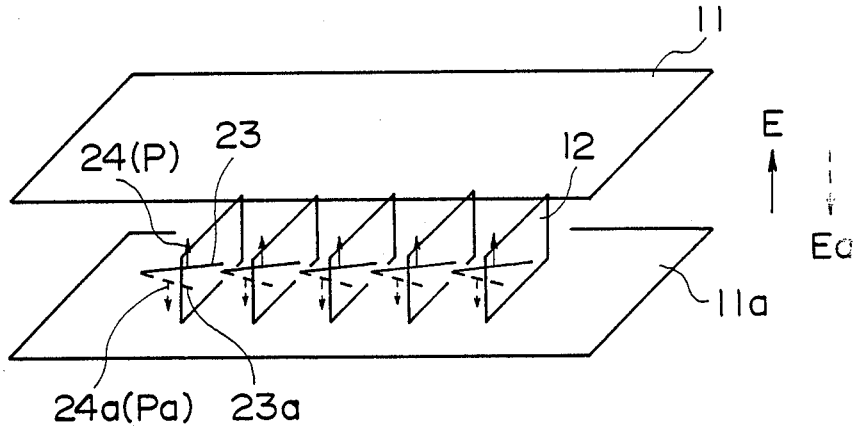

FIG. 1 is a view schematically illustrating an example of a liquid crystal cell for the purpose of explaining the operation of a ferroelectric liquid crystal. Reference numerals 11 and 11*a* denote base plates (glass plates) coated with transparent electrodes comprising thin films of $In_2O_3$, $SnO_2$, ITO (Indium-Tin Oxide), etc. A liquid crystal having SmC*- or SmH*-phase, in which liquid crystal layers 12 are oriented vertically to the surfaces of base plates is hermetically disposed between the base plates 11 and 11*a*. Full lines 13 denote liquid crystal molecules, respectively. These liquid crystal molecules 13 have dipole moments ($P_\perp$) 14 perpendicular to the orientation of the molecules. When a voltage higher than a certain threshold is applied between electrodes on the base plates 11 and 11*a*, the helical structures of liquid crystal molecules 13 are loosened. Thus, the orientation directions of liquid crystal molecules 13 can be changed so that dipole moments ($P_\perp$) 14 are all directed in the direction of the applied electric field. Liquid crystal molecules 13 have elongated shapes, and show refractive index anisotropy between the long and short axes. Accordingly, it is easily understood that, for instance, when polarizers having a cross nicol relationship to each other, (i.e., their polarizing axes are crossing or perpendicular to each other) are arranged on the upper and lower sides of the glass surfaces, a liquid crystal optical modulation device, having optical characteristics which change, depending upon the polarity of an applied voltage, can be realized. When the thickness of the liquid crystal layer used in the liquid crystal cell is made sufficiently thin (e.g., about 1 $\mu$), the helical structures of the liquid crystal molecules are loosened even in the absence of an electric field as shown in FIG. 2. Dipole moments P and Pa can change in either direction, i.e., in upper (24) and lower (24*a*) directions, respectively. When electric fields E and Ea having polarities different from each other and higher than a certain threshold level are applied to the cell thus formed with voltage applying means 11 and 11*a*, the dipole moments change in the upper (24) or lower (24*a*) direction, depending upon the electric field vector of the electric field E or Ea, respectively. In accordance with the changes, the liquid crystal molecules are oriented to either of the first stable state 23 and the second stable state 23*a*.

As previously mentioned, the application of such a ferroelectric liquid crystal to an optical modulation device can provide two major advantages. First, the response speed is quite fast. Second, the liquid crystal molecules show bistability in regard to their orientation. The second advantage will be further explained, e.g., with reference to FIG. 2. When the electric field E is applied, the liquid crystal molecules are oriented to the first stable state 23. This state is stably maintained even if the applied electric field is removed. On the other hand, when the opposite electric field Ea is applied, they are oriented to the second stable state 23*a* to change their direction. Likewise, the latter state is stably maintained even if the applied electric field is removed. Further, as long as the given electric field E or Ea is not above a certain threshold level, they are maintained at their respective oriented states. For effectively realizing such high response speed and bistability, it is preferable that the thickness of the cell is as thin as possible and generally 0.5 to 20 $\mu$, particularly 1 to 5 $\mu$. A liquid crystal electrooptical device having a matrix electrode structure in which the ferroelectric liquid crystal of this kind is used is proposed, e.g., in the specification of U.S. Pat. No. 4,367,924 of Clark and Ragerwall.

The operation of a ferroelectric liquid crystal device has been explained above with reference to a somewhat idealistic mode. The microscopic mechanism of switching due to an electric field applied to a ferroelectric liquid crystal having bistability has not been fully clarified. Generally speaking, however, the ferroelectric liquid crystal can retain its stable state semi-permanently, if it has been switched or oriented to the stable state by the application of a strong electric field for a predetermined time and is left standing under absolutely no electric field. However, when a an electric field of a reverse polarity is applied to the liquid crystal for a long period of time, even if the electric field is sufficiently weak (corresponding to a voltage below the threshold value in the previous example) that the stable state of the liquid crystal is not switched in a predetermined time for writing, the liquid crystal can change its stable state to the other state, whereby correct display or modulation of information cannot be accomplished. We have recognized that the liability of such switching or reversal of oriented states under the long term application of a weak electric field is affected by the material and roughness of the base plate contacting the liquid crystal and the kind of the liquid crystal, but have not clarified the effects quantitatively. We have confirmed that a monoaxial treatment of the base plate such as rubbing or oblique or tilt vapor deposition of SiO, etc., tends to increase the liability of the above-mentioned reversal of oriented states. This tendency is manifested at higher temperature, rather than lower temperature.

In order to accomplish correct display or modulation of information, it is advisable that electric field in one direction are prevented from being applied to the liquid crystal for a long time.

Hereinbelow, a preferred embodiment of the driving method according to the present invention will be explained with reference to the drawings.

Figure 3:
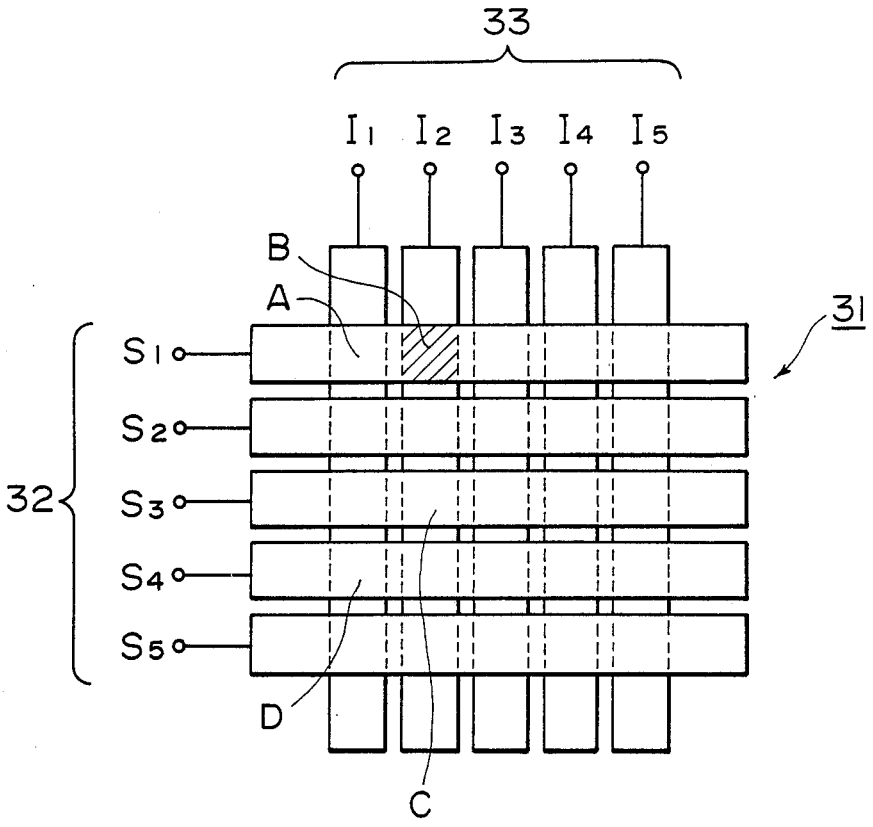
FIG. 3 is a plan view schematically illustrating a matrix electrode arrangement use in the present invention.

FIG. 3 is a view schematically showing a liquid crystal device 31 having a matrix electrode arrangement between which a ferroelectric liquid crystal compound is interposed. Reference numerals 32 and 33 denote a group of scanning lines composed of stripe electrodes and a group of data lines composed of stripe electrodes, respectively.

Figure 4:
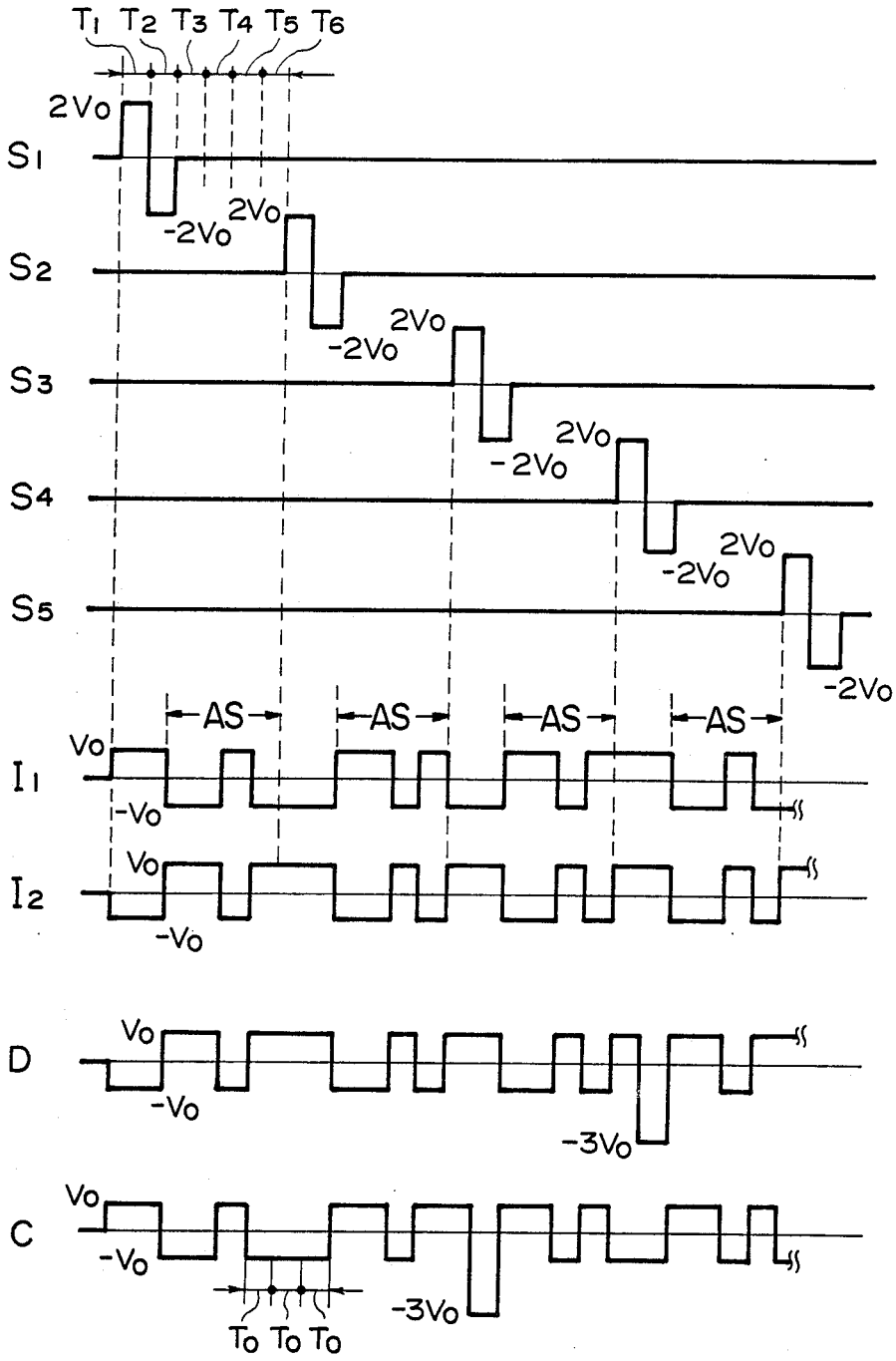
FIGS. 4, 5 and 6 respectively illustrated time-serial waveforms of signals applied to scanning and data lines and voltages applied to picture elements used in the driving method according to the present invention.

FIG. 4 shows the waveforms of signals applied to scanning and data lines and the voltages applied to the picture elements used in a preferred embodiment according to the present invention.

In the embodiment shown in FIG. 4, a scanning selection signal of $2V_0$ in phase $T_1$ and $-2V_0$ in subsequent phase $T_2$ is applied to a scanning line $S_1$ as shown at $S_1$ in FIG. 4. In synchronism with the scanning selection signal, an information signal of $V_0$ (for writing "white") or $-V_0$ (for writing "black") is applied to data lines ($I_1$, $I_2$, . . . ), whereby a voltage of $3V_0$ is applied in phase $T_1$ to a picture element (e.g., picture element B shown in FIG. 3) to write "black" therein and a voltage $-3V_0$ is applied in phase $T_2$ to another picture element (e.g., picture element A shown in FIG. 3) to write "white" therein. Herein, the voltage value $V_0$ is set to satisfy the following relationships:

$$V_0 < V_{th1} < 3V_0, \text{ and}$$

$$-V_0 > -V_{th2} > -3V_0,$$

wherein $V_{th1}$ is a threshold voltage for a first stable orientation state, and $V_{th2}$ is a threshold voltage for a second stable state.

Furthermore, voltage waveforms shown at D and C in FIG. 4 are applied to picture elements D and C shown in FIG. 3, whereby these picture elements are respectively written in "white" as shown in FIG. 3.

Then, in phases $T_3$, $T_4$, $T_5$ and $T_6$, an alternating auxiliary signal is applied to data lines. Herein, the term "alternating signal" means that the signal crosses a reference potential 10 volt or a bias voltage level, if any) at least once. By application of the alternating auxiliary signal, even if a signal for writing, e.g., "black" is successively applied from a data line in phases $T_1$ and $T_2$ to a picture element which has been written in "white", the period in which a voltage signal of the same polarity as the signal for writing "black" is restricted to $3T_0$ ($T_0$: unit pulse duration) at the maximum because an auxiliary period comprising phases $T_3$, $T_4$, $T_5$ and $T_6$ for applying an alternating auxiliary signal is provided, whereby a picture element in which a signal state has been written does not reverse but retains the signal state for a period of substantially one frame or one field. Herein, the total of phases $T_1$, $T_2$, $T_3$, $T_4$, $T_5$ and $T_6$ corresponds to one horizontal scanning period.

In a preferred embodiment according to the present invention, the average potential of the combination of the alternating auxiliary signal and the information signal applied to a data line may be a reference potential (a bias voltage level when a bias voltage is applied or 0 volt when no bias voltage is applied). The alternating auxiliary signal preferably comprises a rectangular pulse, and the pulse duration $T_0$ ($T_3$, $T_4$, $T_5$ or $T_6$) is preferably equal to or shorter than the pulse duration T ($T_1$ or $T_2$=0.1 μsec to 1 msec) of the information signal, e.g., 0.1 to 1.0 times T.

Figure 5:
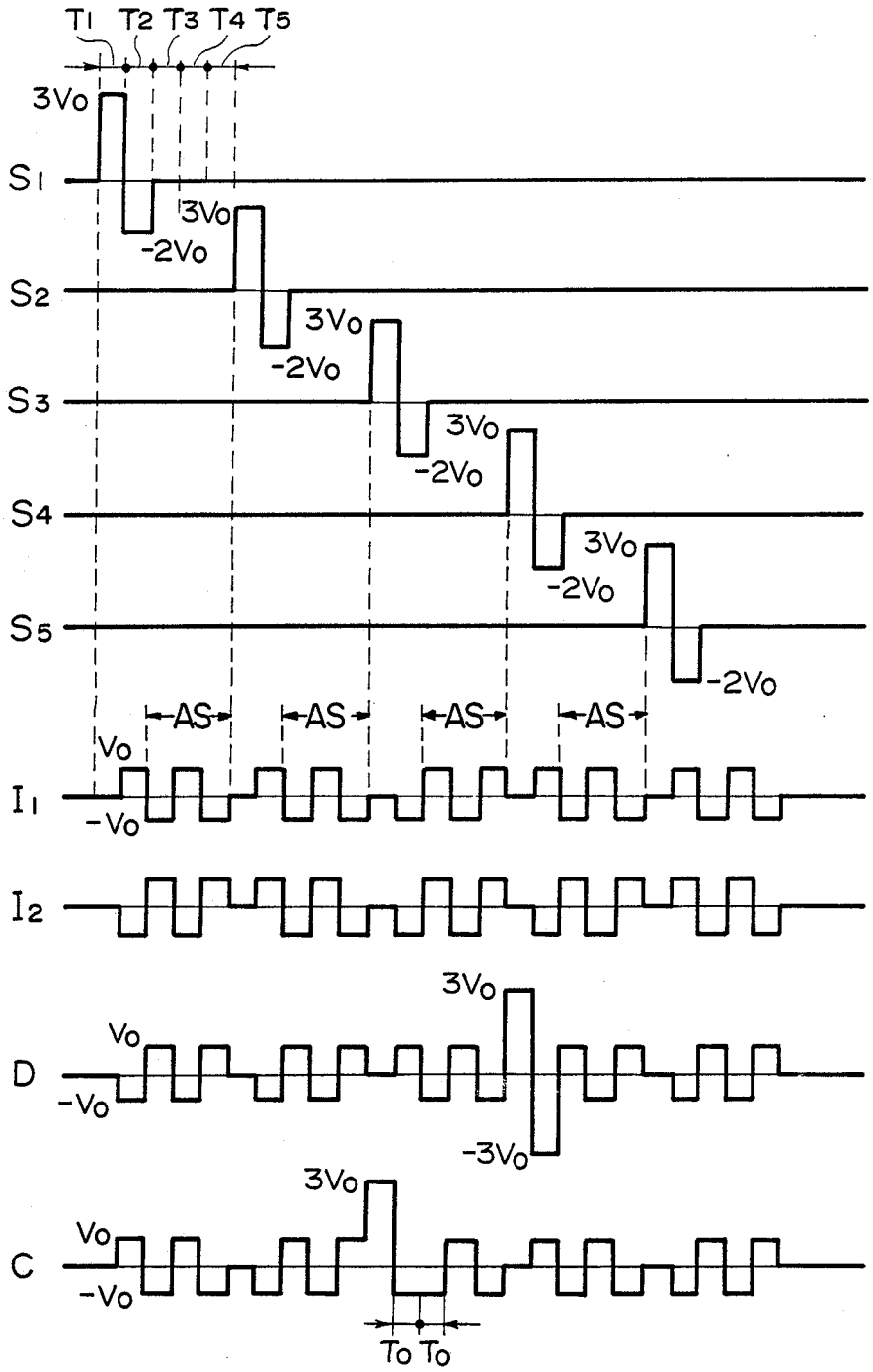

FIG. 5 shows the waveforms of signals and voltages applied in another preferred driving embodiment.

In the embodiment shown in FIG. 5, in phase $T_1$, an electric signal (i.e., a voltage) of $3V_0$ is applied to all the picture elements on a scanning line $S_1$ to be written, whereby the signal states written in the preceding field or frame are erased into "white" states. Then, in the subsequent phase $T_2$, a scanning selection signal of $-2V_0$ is applied to the scanning line. In synchronism with the scanning selection signal, an information selection signal of $V_0$ for writing "black" or an information non-selection signal of $-V_0$ for holding the "white" state is applied to data lines.

In this driving mode wherein writing and erasure are effected line by line for scanning lines to form an image, the above mentioned reversed phenomenon also occurs. In this embodiment, phases $T_3$, $T_4$ and $T_5$ are provided for applying an alternating auxiliary signal, so that the above mentioned reversal phenomenon can be prevented. This alternating auxiliary signal may have an opposite polarity in phase $T_3$, the same polarity in phase $T_4$ and an opposite polarity in phase $T_5$ with respect to an information signal applied to the data line in phase $T_2$. The average potential of the electric signals applied to a data line throughout one field or frame period is a bias voltage or 0 volt as in the driving example explained with reference to FIG. 4.

In this embodiment, as seen from FIG. 5, the maximum period in which one polarity of voltages is continually applied to a picture element is $2T_0$ ($T_0$: unit pulse duration), whereby the above mentioned reversal phenomenon does not occur at all. The total period of phases $T_1$, $T_2$, $T_3$, $T_4$ and $T_5$ corresponds to one horizontal scanning period.

Figure 6:
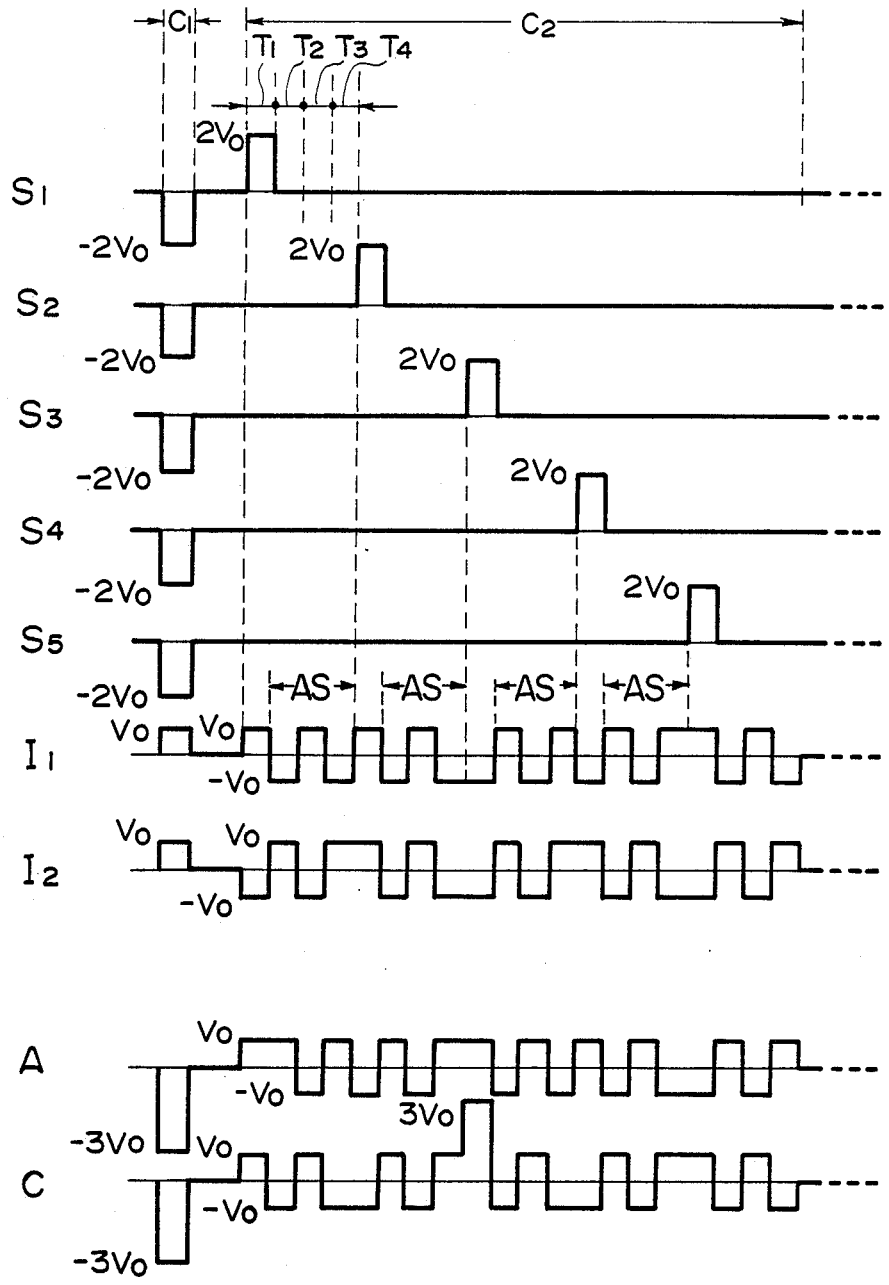

FIG. 6 shows waveforms of signals and voltages applied in still another embodiment according to the present invention.

In the embodiment shown in FIG. 6, all or a part of the picture elements on the whole picture written in the previous field or frame is erased (written in "black") at the same time and then successively written (in "white"). More specifically, in an erasure step $C_1$, $-2V_0$ is applied to the scanning lines simultaneously while $V_0$ is applied to the data lines, whereby a voltage of $-3V_0$ is applied to all the picture elements to erase the whole picture into "black". In a subsequent writing step $C_2$, a scanning selection signal of $2V_0$ is applied to the scanning lines line by line, and in synchronism with the scanning selection signal, an information selection signal of $-V_0$ for writing "white" or an information non-selection signal of $V_0$ for retaining the "black" state is applied to data lines in phase $T_1$.

In this embodiment, phases $T_2$, $T_3$ and $T_4$ are provided for applying an alternating auxiliary signal. The alternating auxiliary signal is a signal having an opposite polarity in phase $T_2$, the same polarity in phase $T_3$ and an opposite polarity in phase $T_4$ with respect to an information signal applied to the data line in phase $T_1$. By applying the alternating auxiliary signal to data lines in phases $T_2$, $T_3$ and $T_4$, the maximum period wherein one polarity of voltage is applied to a picture element is restricted to $3T_0$ ($T_0$: unit pulse duration), so that the above mentioned reversal phenomenon does not occur. The total period of phases $T_1$, $T_2$, $T_3$ and $T_4$ corresponds to one horizontal scanning period.

Waveforms indicated at D and C in FIG. 5 and at A and C in FIG. 6 are those of voltage applied to picture elements D, C and A shown in FIG. 3, while the displayed states do not accurately correspond respectively.

In the above embodiments, the pulse durations of each alternating auxiliary signal applied in different phases may be the same or different from each other, and the peak value or height of the pulse can be varied depending on the pulse durations.

Figure 7:
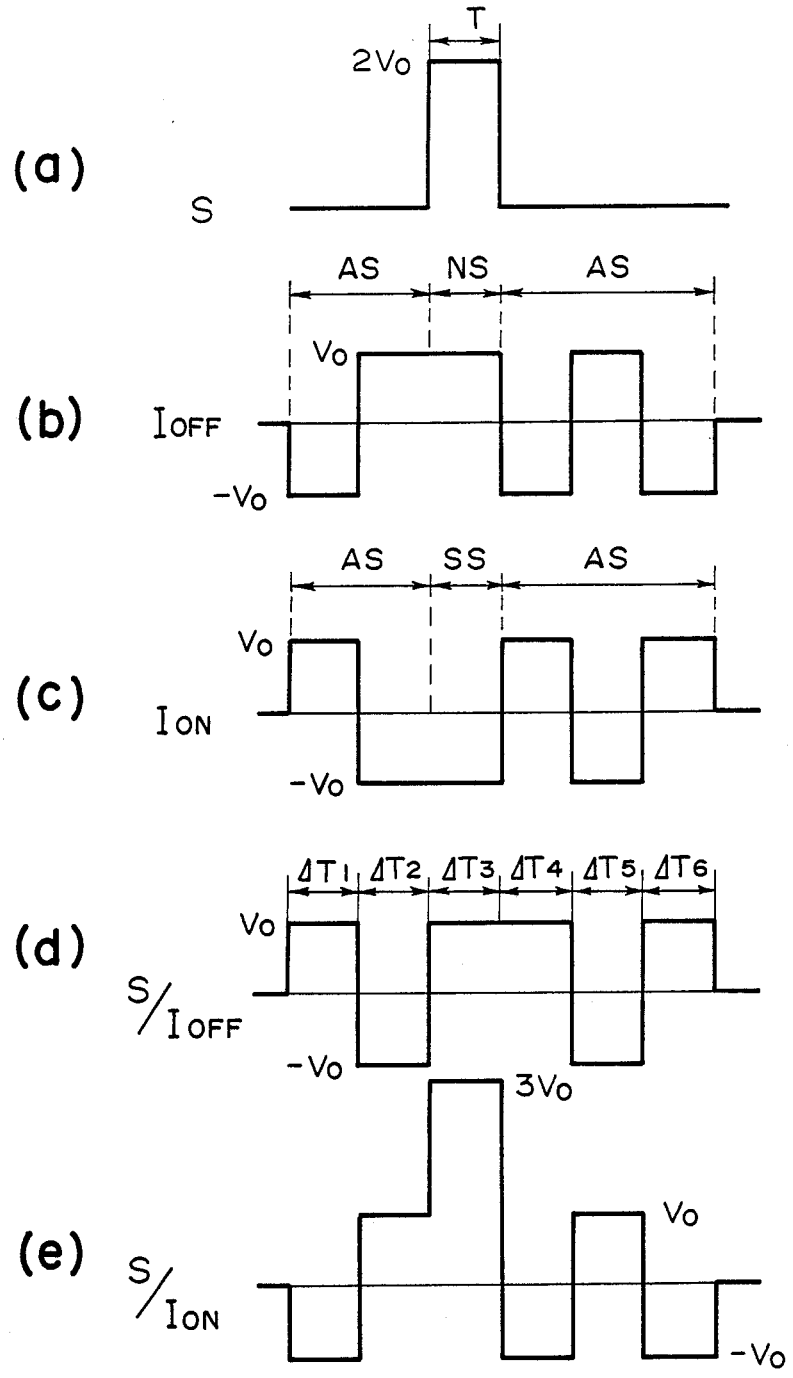
FIG. 7(*a*)–(*e*), FIG. 8(*a*)–(*e*) and FIG. 9(*a*)–(*e*) respectively show signals and voltages applied in other embodiments of the driving method according to the present invention.

FIG. 7 shows a modification of the alternating auxiliary signal used in the driving mode shown in FIG. 6, wherein the whole picture elements are erased simultaneously and then written successively. FIG. 7(*a*) shows a scanning selection signal of $2V_0$ applied to a scanning line S, while FIG. 7(*b*) and 7(*c*) show an information non-selection signal NS at $I_{OFF}$ and an information selection signal SS at $I_{ON}$, respectively, combined with alternating auxiliary signals AS. FIGS. 7(*d*) and 7(*e*) show a voltage waveform $S/I_{OFF}$ applied to a picture element to which the information non-selection signal is applied and a voltage waveform $S/I_{ON}$ applied to a picture element to which the information selection signal is applied, respectively, on a scanning line to which the scanning selection signal is applied.

In the waveform shown in FIG. 7(*d*), the phase periods may be set to satisfy the relationship: $\Delta T_3=\Delta T_6=\Delta T$, $\Delta T_1=\Delta T_2=\delta_1$, $\Delta T_4=\Delta T_5=\delta_2$, $\delta_1<\Delta T$ and $\delta_2<\Delta T$. In this case, the maximum period in which an electric field in a reverse direction is continually applied is either $\Delta T+\delta_2$ or $\Delta T+\delta_1$ which is anyway shorter than $2\Delta T$. In this embodiment, as shown in FIGS. 7(*b*) and 7(*c*), the alternating auxiliary signals applied before and after the information signals are reverse in directions between those combined with the information non-selection signal and those combined with the information selection signal. Moreover, the portions of the alternating auxiliary signals immediately before and after an information signal are mutually opposite in direction or polarity with respect to the reference potential. Because of these features, a period in which one polarity of voltage is continually applied to a picture element does not exceed 3 $\Delta T$.

As shown in FIG. 7, a first alternating auxiliary signal and a second alternating auxiliary signal are respectively applied before and after a phase for applying an information signal, whereby the above mentioned reversal phenomenon is effectively prevented.

Figure 8:
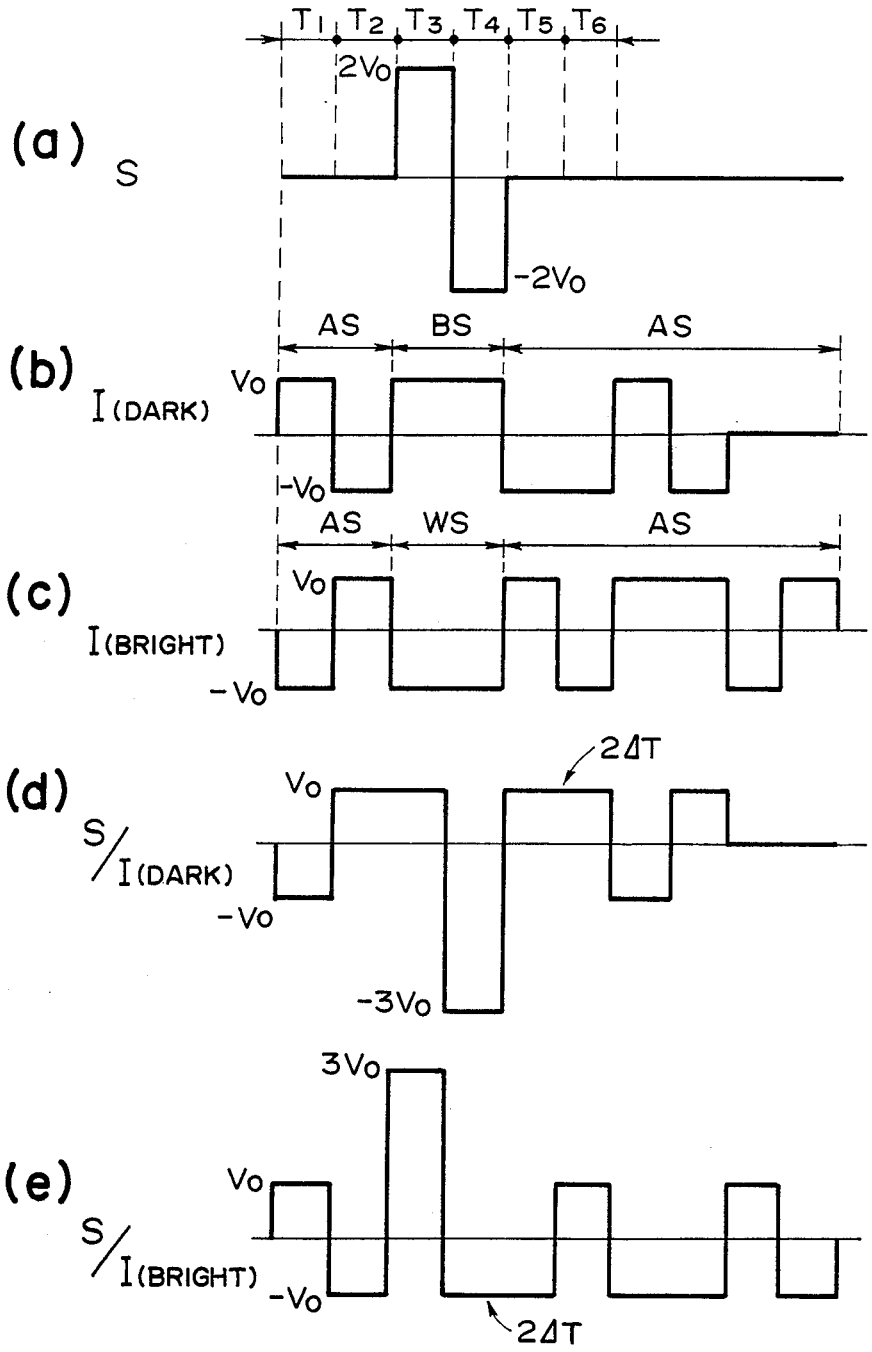
Figure 9:
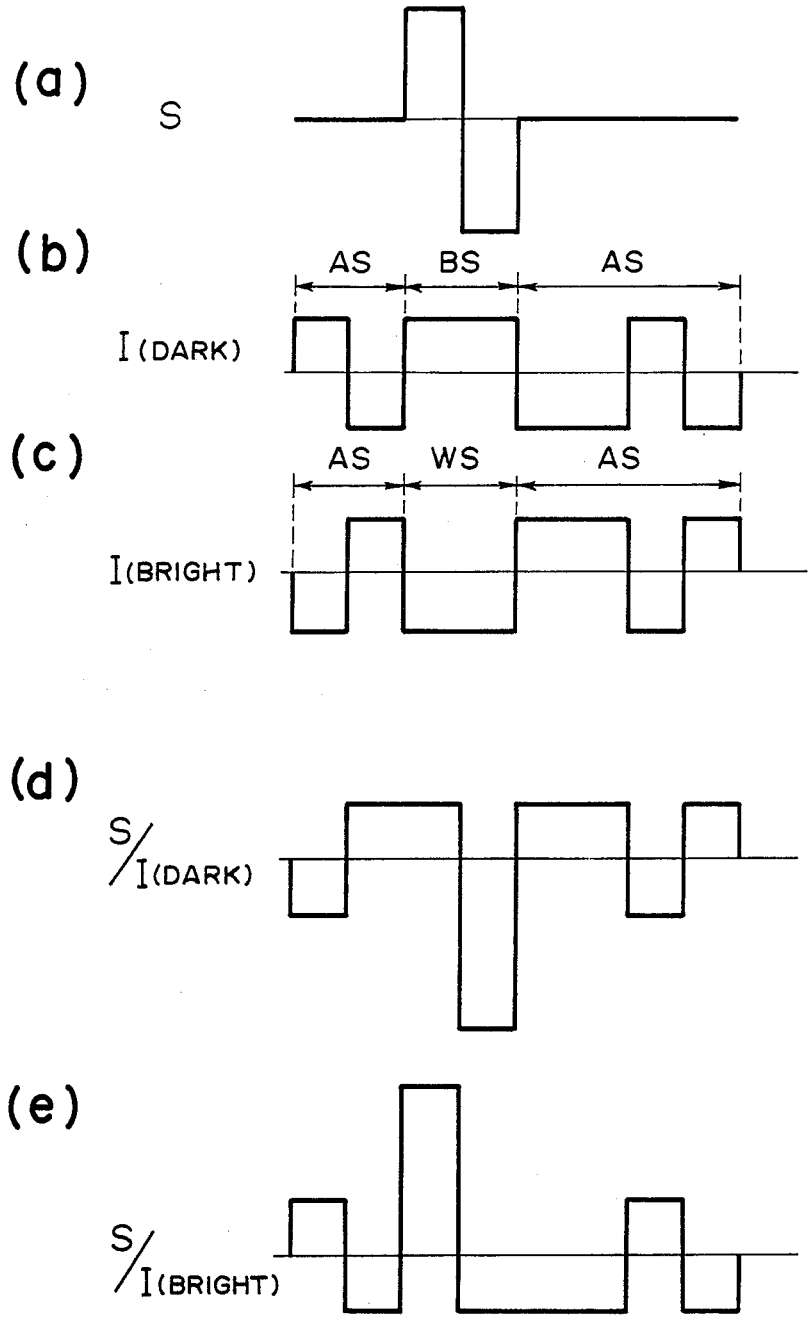

FIGS. 8 and 9 respectively show a modification of a driving mode wherein picture elements on one scanning line are written in "black (dark)" or "white (bright)" simultaneously. More specifically, FIGS. 8 and 9 respectively show an embodiment wherein phases for applying a first alternating auxiliary signal and a second alternating auxiliary signal are added respectively before and after a phase for applying an information signal.

In the embodiment shown in FIG. 8, a scanning selection signal of $2V_0$ in phase $T_3$ and $-2V_0$ in phase $T_4$ ($T_3=T_4=\Delta T$) is applied to a scanning line. In synchronism with the scanning selection signal, an information signal BS for writing "black" is applied to a data line $I_{(DARK)}$ and an information signal WS for writing "white" is applied to a data line $I_{(BRIGHT)}$. Further, phases for applying a first auxiliary signal AS and a second auxiliary signal AS are provided respectively before and after the phases for applying these information signals, whereby a period in which a voltage in a reverse direction is applied can be shortened to $2\Delta T$. In this instance, the unit pulse duration of the alternating auxiliary signal is not necessarily the same as that of the information signal. FIG. 8(*d*) shows a voltage waveform $S/I_{(DARK)}$ applied to a picture element which is written in "black" and FIG. 8(*e*) shows a voltage waveform $S/I_{(BRIGHT)}$ applied to a picture element which is written in "white".

FIG. 9 shows a modification of the embodiment shown in FIG. 8. In this embodiment, alternating auxiliary signals corresponding to but having different waveforms from the alternating auxiliary signals used in the embodiment of FIG. 8 are used. FIG. 9(*a*) shows a selection scanning signal, FIG. 9(*b*) a combination of a signal BS for writing "black" with auxiliary signals AS, FIG. 9(*c*) a combination of a signal WS for writing "white" with auxiliary signals AS, FIG. 9(*d*) a voltage waveform applied to a picture element for writing "black", and FIG. 9(*e*) a voltage waveform applied to a picture element for writing "white".

Hereinbelow, the present invention will be explained with reference to a specific example.

EXAMPLE 1

A pair of glass plates provided with patterned transparent electrodes of ITO so as to form a matrix of 500×500 picture elements were respectively coated with an about 300 Å-thick polyimide film by spin coating. These coated glass plates were respectively subjected to a rubbing treatment with a suede-finished cotton cloth wrapped around a roller and applied to each other with their rubbing directions in alignment, whereby a cell was formed. A ferroelectric liquid crystal DOBAMBC was injected into the cell and gradually cooled from its isotropic phase to assume an SmC* phase in a monodomain state. While the cell was kept at a temperature of 70° C., an image was formed by a driving mode as explained with reference to FIG. 4, whereby an excellent image was formed with no irregularity in image caused by reversal phenomenon during image formation.

The driving method according to the present invention can be widely applicable to the fields of optical shutters such as liquid crystal-optical shutters and display devices such as liquid crystal television sets.

What is claimed is:

1. A liquid crystal apparatus, comprising:

a ferroelectric liquid crystal device having:

a group of scanning electrodes;

a group of signal electrodes disposed to intersect the scanning electrodes; and a ferroelectric liquid crystal having a first and a second threshold voltage of one and another polarity, respectively, disposed between the scanning electrodes and the signal electrodes so as to form a picture element at each intersection; and voltage signal application means for:

(a) applying to a selected scanning electrode a scanning selection signal comprising;

a voltage of one polarity or another polarity with respect to the voltage level of a non-selected scanning electrode; and a same level voltage which is at the same voltage level as that of the non-selected scanning electrode;

(b) applying to a selected electrode an information signal comprising:

a first voltage signal providing a voltage exceeding the first or second threshold voltage in synchronism with said voltage of one polarity or another polarity; and an alternating voltage signal commencing with a voltage of a polarity opposite to that of the first voltage signal with respect to the voltage level of the non-selected scanning electrode in the application period of said same level voltage; and (c) applying to another signal electrode an information signal comprising:

a second voltage signal providing a voltage not exceeding the first or second threshold voltage of the ferroelectric liquid crystal in synchronism with said voltage of one polarity or the another polarity; and an alternating voltage signal commencing with a voltage of a polarity opposite to that of the second voltage signal with respect to the voltage level of the non-selected scanning electrode in the application period of said same level voltage.

2. The apparatus according to claim 1, wherein the average voltage of each of the information signals is at the same level as the voltage level of the non-selected scanning electrode throughout the application period of the scanning selection signal.

3. The apparatus according to claim 1, wherein the voltage level of the non-selected scanning electrode is zero.

4. The apparatus according to claim 1, wherein each of the first and second voltage signals has a pulse duration T and each of the alternating voltage signals comprises pulses having unit pulse duration $T_0$ which is shorter than T.

5. The apparatus according to claim 1, wherein said ferroelectric liquid crystal is a chiral smectic liquid crystal.

6. The apparatus according to claim 5, wherein said chiral smectic liquid crystal assumes a non-spiral structure.

7. The apparatus according to claim 5, wherein said chiral smectic liquid crystal is in the C phase, the H phase, the I phase, the J phase, the K phase, the G phase or the F phase.

8. The apparatus according to claim 1, wherein each of the alternating voltage signals is applied after the first or second voltage signal and another alternating voltage signal is applied before the first or second voltage signal.

9. A liquid crystal apparatus, comprising:
a ferroelectric liquid crystal device comprising:
a group of scanning electrodes;
a group of signal electrodes disposed to intersect the scanning electrodes; and
a ferroelectric liquid crystal having a first and a second threshold voltage of one and another polarity, respectively, disposed between the scanning electrodes and the signal electrodes so as to form a picture element at each intersection; and
voltage signal application means for:
(a) applying to a selected scanning electrode a scanning selection signal comprising:
a voltage of one polarity and a voltage of another polarity, respectively, with respect to the voltage level of a non-selected scanning electrode; and
a same level voltage at the same voltage level as that of the non-selected scanning electrode;
(b) applying to a selected signal electrode an information signal comprising:
a first voltage signal providing a voltage exceeding the first threshold voltage in synchronism with said voltage of one polarity; and
an alternating voltage signal commencing with a voltage of a polarity opposite to that of the first voltage signal with respect to the voltage level of the non-selected scanning electrode in the application period of said same level voltage; and
(c) applying to another signal electrode an information signal comprising:
a second voltage signal providing a voltage exceeding the second threshold voltage of the ferroelectric liquid crystal in synchronism with said voltage of another polarity; and
an alternating voltage signal commencing with a voltage of a polarity opposite to that of the second voltage signal with respect to the voltage level of the non-selected scanning electrode in the application period of said same level voltage.

10. The apparatus according to claim 9, wherein the voltage of one polarity and the voltage of the another polarity in the scanning selection signal are consecutive in time.

11. The apparatus according to claim 9, wherein the voltage level of the non-selected scanning electrode is zero.

12. The apparatus according to claim 9, wherein each of the first and second voltage signals has a pulse duration T and each of the alternating voltage signals comprises pulses having a unit pulse duration $T_0$ which is shorter than T.

13. The apparatus according to claim 9, wherein said ferroelectric liquid crystal is a chiral smectic liquid crystal.

14. The apparatus according to claim 13, wherein said chiral smectic liquid crystal assumes a non-spiral structure.

15. The apparatus according to claim 13, wherein said chiral smectic liquid crystal is in the C phase, the H phase, the I phase, the J phase, the K phase, the G phase, or the F phase.

16. The apparatus according to claim 9, wherein each of the alternating voltage signals is applied after the first or second voltage signal and another alternating voltage signal is applied before the first or second voltage signal.

17. The apparatus according to claim 9, wherein each of the information signals integrally assumes a voltage of the same level as the voltage level of the non-selected scanning electrode throughout the application period of the scanning selection signal.

18. A liquid crystal apparatus, comprising:
a ferroelectric liquid crystal device comprising:
a group of scanning electrodes;
a group of signal electrodes disposed to intersect the scanning electrodes; and
a ferroelectric liquid crystal having a first and a second threshold voltage of one and another polarity, respectively, disposed between the scanning electrodes and the signal electrodes so as to form a picture element at each intersection; and
voltage signal application means for:
(a) applying to a selected scanning electrode a scanning selection signal comprising:
a voltage of one polarity and a voltage of another polarity with respect to the voltage level of a non-selected scanning electrode; and
a same level voltage which is at the same voltage level as that of the non-selected scanning electrode;
(b) applying to all or a prescribed number of the signal electrodes a first voltage signal providing a voltage exceeding the first threshold voltage of the ferroelectric liquid crystal in synchronism with said voltage of one polarity; and
(c) applying to a selected signal electrode an information signal comprising:
a second voltage signal providing a voltage not exceeding the second threshold voltage of the ferroelectric liquid crystal in synchronism with said voltage of the another polarity; and
an alternating voltage signal commencing with a voltage of a polarity opposite to that of the second voltage signal with respect to the voltage level of the non-selected scanning electrode in the application period of said same level voltage.

19. The apparatus according to claim 18, wherein the voltage of one polarity and the voltage of the another polarity in the scanning selection signal are consecutive in time.

20. The apparatus according to claim 18, wherein the voltage level of the non-selected scanning electrode is zero.

21. The apparatus according to claim 18, wherein each of the first and second voltage signals has a pulse duration T and the alternating voltage signal comprises pulses having a unit pulse duration $T_0$ which is shorter than T.

22. The apparatus according to claim 18, wherein said ferroelectric liquid crystal is a chiral smectic liquid crystal.

23. The apparatus according to claim 22, wherein said chiral smectic liquid crystal assumes a non-spiral structure.

24. The apparatus according to claim 22, wherein said chiral smectic liquid crystal is in the C phase, the H phase, the I phase, the J phase, the K phase, the G phase or the F phase.

25. The apparatus according to claim 18, wherein the alternating voltage signal is applied after the first or second voltage signal and another alternating voltage signal is applied before the first or second voltage signal.

26. The apparatus according to claim 18, wherein said voltage of one polarity is applied to all or a prescribed number of the scanning electrodes simultaneously.

27. The apparatus according to claim 18, wherein the average voltage of the information signal is at the same level as the voltage level of the non-selected scanning electrode throughout the application period of the scanning selection signal.

28. A driving method for a liquid crystal device of the type comprising a matrix electrode structure having a first group of stripe electrodes and a second group of stripe electrodes disposed opposite to and intersecting the first group of stripe electrodes, and a ferroelectric liquid crystal displaying a first state and a second state and disposed between the first and second groups of stripe electrodes so as to form a picture element at each intersection of the stripe electrodes, said driving method comprising the steps of:

applying a first voltage signal to a plurality of said picture elements for orienting the ferroelectric liquid crystal in the first state in a first phase for a duration $\Delta T$, and applying a second voltage signal to said plurality of picture elements for orienting the ferroelectric liquid crystal in the second state in a second phase for a duration $\Delta T$, whereby writing is effected in the first and second phases; and applying to the remaining picture elements an alternating voltage signal such that the maximum duration during which any voltage of one polarity of the alternating voltage is applied to the remaining picture elements is $3\Delta T$.

29. The driving method according to claim 28, wherein said first and second phases are consecutive in time.

30. The driving method according to claim 29, wherein the average potential of the alternating voltage signal throughout the application period of the scanning selection signal is substantially equal to a reference potential, wherein said reference potential is zero.

31. The driving method according to claim 28, wherein said ferroelectric liquid crystal is a chiral smectic liquid crystal.

32. The driving method according to claim 31, wherein said chiral smectic liquid crystal assumes a non-spiral structure.

33. The driving method according to claim 31, wherein said chiral smectic liquid crystal is in the C phase, the H phase, the I phase, the J phase, the K phase, the G phase or the F phase.

34. The driving method according to claim 28, further comprising the step of:

applying to a selected first stripe electrode a scanning selection signal comprising a voltage of one polarity and a voltage of another polarity, respectively, with respect to the voltage level of a non-selected first strips electrode, and in synchronism with the scanning selection signal, and applying to a signal electrode an information signal which integrally assumes the same voltage level as the voltage level of the non-selected first stripe electrode throughout the application period of the scanning selection signal.

35. The driving method according to claim 34, wherein the voltage level of said non-selected first stripe electrode is zero.

36. A driving method for a liquid crystal device of the type comprising a matrix electrode structure having a plurality of first stripe electrodes and a plurality of second stripe electrodes disposed opposite to and intersecting said first stripe electrodes, and a ferroelectric liquid crystal displaying a first state and a second state and disposed between the first and second stripe electrodes so as to form a picture element at each intersection of the stripe electrodes; said driving method comprising the steps of:

in a first phase, applying a voltage signal for orienting the ferroelectric liquid crystal in the first stage simultaneously to the intersections of all or a prescribed part of the first strips electrodes and all or a prescribed part of the second stripe electrodes;

in a second phase, applying to a selected first stripe electrode a scanning selection signal comprising:

a voltage with a duration $\Delta T$ of one or another polarity with respect to the voltage level of the non-selected first stripe electrode; and a same level voltage which is at the same voltage level as that of the non-selected first stripe electrode; and applying an information signal comprising an alternating voltage in synchronism with the scanning selection signal; and applying to the intersections of the second stripe electrodes and a non-selected first stripe electrode an alternating voltage signal such that the maximum duration during which any voltage of one polarity of the alternating voltage is applied to said intersections is $3\ \Delta T$.

37. The driving method according to claim 36, wherein said ferroelectric liquid crystal is a chiral smectic liquid crystal.

38. The driving method according to claim 37, wherein said chiral smectic liquid crystal assumes a non-spiral structure.

39. The driving method according to claim 37, wherein said chiral smectic liquid crystal is in the C phase, the H phase, the I phase, the G phase or the F phase.

40. The driving method according to claim 36, wherein the voltage level of said non-selected first stripe electrode is zero.

41. The driving method according to claim 36, wherein the average voltage of the information signal is at the same voltage level as the voltage level of the non-selected first stripe electrode throughout the application period of the scanning selection signal.

42. The driving method according to claim 41, wherein the voltage level of said non-selected first stripe electrode is zero.

* * * * *

UNITED STATES PATENT AND TRADEMARK OFFICE

CERTIFICATE OF CORRECTION

PATENT NO. : 4,800,382

DATED : January 24, 1989

INVENTOR(S) : SHINJIRO OKADA, ET AL.

It is certified that error appears in the above-identified patent and that said Letters Patent is hereby corrected as shown below:

IN [56] REFERENCES CITED

OTHER PUBLICATIONS, Column 2, "Submicrosecond Bistable Electr-Optic" should read --Submicrosecond Bistable Electro-Optic--.

COLUMN 1

Line 32, "plate, moreover, involves" should read --plate; moreover,--.

Line 38, "exhibit" should read --exhibits--.

COLUMN 3

Line 51, "electrooptical" should read --electro-optical--.

Line 66, "a an" should read --an--.

COLUMN 8

Line 52, "having" should read --having a--.

COLUMN 11

Line 56, "strips" should read --stripe--.

UNITED STATES PATENT AND TRADEMARK OFFICE

CERTIFICATE OF CORRECTION

PATENT NO. : 4,800,382

DATED : January 24, 1989

INVENTOR(S) : SHINJIRO OKADA, ET AL.

It is certified that error appears in the above-identified patent and that said Letters Patent is hereby corrected as shown below:

COLUMN 12

Line 17, "stage" should read --state--.
Line 47, "the I phase, the G phase" should read --the I phase, the J phase, the K phase, the G phase--.

Signed and Sealed this

Twenty-first Day of November, 1989

*Attest:*

JEFFREY M. SAMUELS

*Attesting Officer*

*Acting Commissioner of Patents and Trademarks*